United States Patent [19]

Hagemeyer

[11] Patent Number: 4,716,700

[45] Date of Patent: Jan. 5, 1988

[54] DOOR

[75] Inventor: Bruce A. Hagemeyer, Pella, Iowa

[73] Assignee: Rolscreen Company, Pella, Iowa

[21] Appl. No.: 946,443

[22] Filed: Dec. 23, 1986

Related U.S. Application Data

[63] Continuation-in-part of Ser. No. 732,950, May 13, 1985, Pat. No. 4,630,420.

[51] Int. Cl.[4] ..... E06B 3/70

[52] U.S. Cl. ..... 52/456; 52/313

[58] Field of Search ..... 52/313, 455, 456, 457, 52/458; 428/464

[56] References Cited

U.S. PATENT DOCUMENTS

| | | | |
|---|---|---|---|
| 670,858 | 3/1901 | Emerson | 52/455 |
| 1,652,314 | 12/1927 | Ladlow | 428/464 |
| 2,011,130 | 8/1935 | Ward | 428/464 |
| 2,241,312 | 5/1941 | Lüty | 428/464 |
| 3,305,992 | 2/1967 | Steed | 52/455 |
| 3,512,304 | 5/1970 | Meuret | 52/456 |
| 4,265,068 | 5/1981 | Pomroy | 52/456 |
| 4,513,533 | 4/1985 | Barry | 52/456 |

FOREIGN PATENT DOCUMENTS

| | | | |
|---|---|---|---|
| 2825914 | 12/1978 | Fed. Rep. of Germany | 52/455 |
| 1342737 | 9/1963 | France | 52/456 |

*Primary Examiner*—Henry E. Raduazo

*Attorney, Agent, or Firm*—Zarley, McKee, Thomte, Voorhees & Sease

[57] ABSTRACT

A thermal and moisture resistant door comprising a perimeter framework consisting of top and bottom rails and opposite vertical stiles and an interior framework secured to the stiles and rails. The interior framework consists of a series of panels fitted into the stiles and rails. The stiles and rails are a 9-ply structure consisting of a pine core having on the interior and exterior sides two cross-banding layers, a vapor barrier layer and an outer oak veneer. The panels consist of a 13-ply structure including a pine core having on the interior and exterior sides two cross-banding layers, a vapor barrier layer and inner and outer oak layer. Each edge of each panel is elongated in order to fit into a corresponding oak block on the associated stile or rail. Each panel is routed or moulded such that the inner wood layer is visible, while the remaining layers of the panel are substantially concealed.

8 Claims, 9 Drawing Figures

7
10A
70
69A
68
72
74
68
72
70
75A
74
69B
70
102
77
7

78
69A
76
75A
70
75B
80
82
84
86
88
98
93
90
91
92
96
94
80
82
84
86
74
80
82
88
70
90
84
86
94
96
91
74
92
84
82
80
86
84
86
82
80

80
82
84
86
94
74
96
91
92
93
90
98
75A
80
82
70
84
86
88
75B
100
69B
77
102

DOOR

This is a continuation-in-part application of Ser. No. 732,950, filed May 13, 1985, AN IMPROVED DOOR, which is issuing Dec. 23, 1986 as U.S. Pat. No. 4,630,420.

BACKGROUND OF THE INVENTION

Conventional doors are generally of the stile and rail variety or the flush variety. A stile and rail door is made up of several components, including stiles, rails and panels which are joined together with dowels or special corner joints. In comparison, a flush door may be constructed of either plywood or a steel skin placed over a perimeter frame with or without an interior core. The flush door is perceived by the public as a less expensive door than the stile and rail door and generally has less aesthetic appeal. Plantons or add-on panels may be attached to a flush door to give it a stile and rail appearance. Alternately, a stile and rail pattern may be embossed in the face of a steel door. Both the conventional stile and rail door and the flush door, as well as the add-on panels, are subject to warpage due to temperature differentials across the door and due to moisture absorption by the door. Also, plastic add-on panels are subject to melting deformation caused by the heat of the sun.

It is also desirable in some instances to provide a door which is made nearly completely of wood, with only minute amounts of synthetic substances. One difficulty faced in producing such a door is the cost involved in providing nearly all wood materials.

Therefore, the primary objective of the present invention is the provision of an improved door which is resistant to thermal and moisture deformation.

A further objective of the present invention is the provision of a door consisting essentially of natural substances rather than synthetic substances.

Another objective of the present invention is to provide a door consisting essentially of natural substances which is reasonable in cost.

Another objective of the present invention is the provision of a door having improved thermal insulative properties.

A further objective of the present invention is to provide a door consisting of pieces which may be fit together.

Yet another objective of the present invention is the provision of a door having increased strength.

Another invention of the present invention is the provision of a door which is economical to manufacture, durable in use, and aesthetically appealing.

SUMMARY OF THE INVENTION

The door of the present invention has increased strength and is resistant to thermal and moisture deformation. The door includes a perimeter framework with oak veneer attached thereto on both the interior and exterior sides of the door, and at least one oak decorative panel to provide the door with the desired appearance, such as stile and rail. A series of layers of wood and aluminum layer, along with a sealant means between the attaching portions of the stiles and the decorative panel piece improves the thermal insulative characteristics of the door.

Each of the outer layers of wood and aluminum is glued to adjacent layers. The outer section includes an outer wood veneer layer, a poplar first cross-banding layer, an aluminum vapor-barrier layer, a second poplar cross-banding layer. This outer section is attached to a pine core on the stiles and rails. The decorative panel includes an outer wood veneer layer, a first poplar cross-banding layer, and aluminum vapor-barrier layer, a second poplar cross-banding layer, an oak layer, may include an inner poplar cross-band layer, and also includes a pine core. The inner layers of wood are concealed by the outer veneer layer thereof. The edges of the panels are routered such that the intermediate wood layer and the outer veneer layer are visible while the cross-banding and vapor-barrier layers are substantially concealed. The various layers of the panel and stiles increases strength, warp resistance and thermal bow resistance of the door.

DETAILED DESCRIPTION OF THE PREFERRED EMBODIMENT

Figure 1:
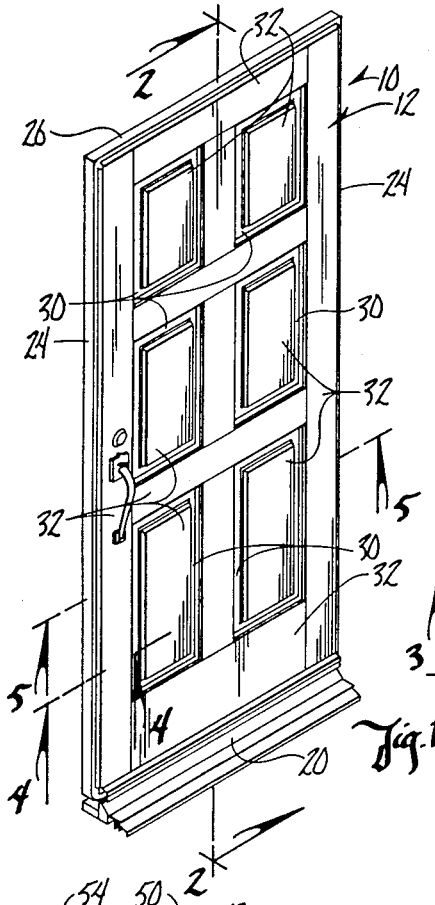
FIG. 1 is a perspective view of the door of the present invention.

The reference numeral 10 generally designates the door of the present invention. Door 10 has an exterior side 12 and an interior side 14 and is mounted in the entryway of a building which includes a door header 16, a threshold 18 with a door sill 20, opposite lock and hinge jambs (not shown), and a door stop member 22 attached to header 16 and the lock jamb adjacent the exterior side of the door. The entryway construction is conventional and not part of the present invention.

Door 10 has a perimeter framework including opposite elongated side frame members 24, a top frame member 26 extending between side frame members 24 at the upper ends thereof, and a bottom frame member 28 extending between side frame members 24 at the lower ends thereof. A laminated skin 30 is attached to the perimeter framework on both the interior and exterior sides of door 10. Also, one or more add-on panels 32 are attached to skin 30 on one or both sides of door 10 for decorative and aesthetic purposes. For example, in FIG. 1, panels 32 have been added to give door 10 a stile and rail appearance.

Figure 3:
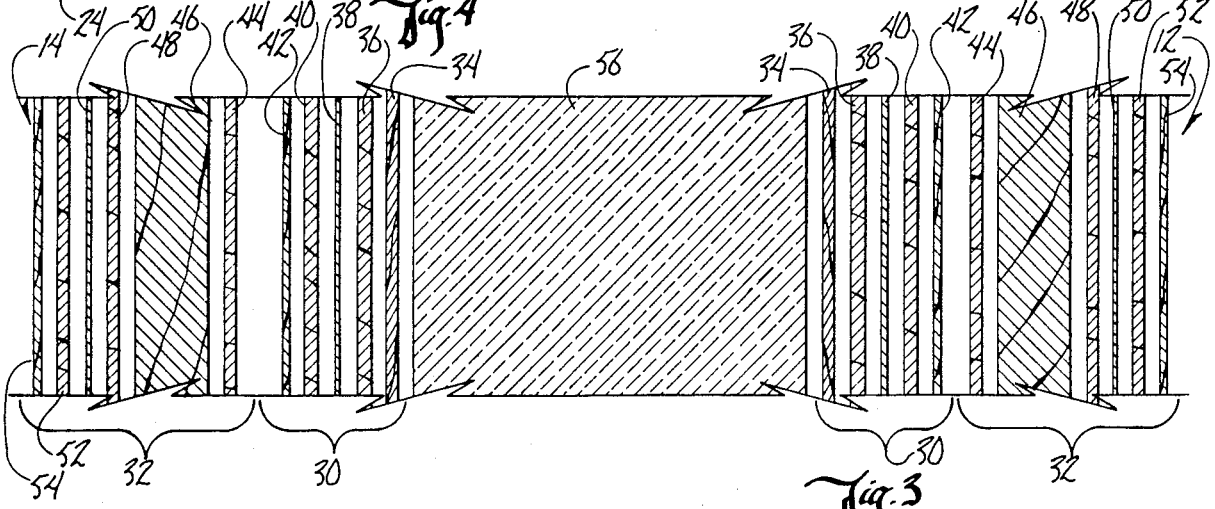
FIG. 3 is an exploded sectional view taken along lines 3—3 of FIG. 2.
Figure 5:
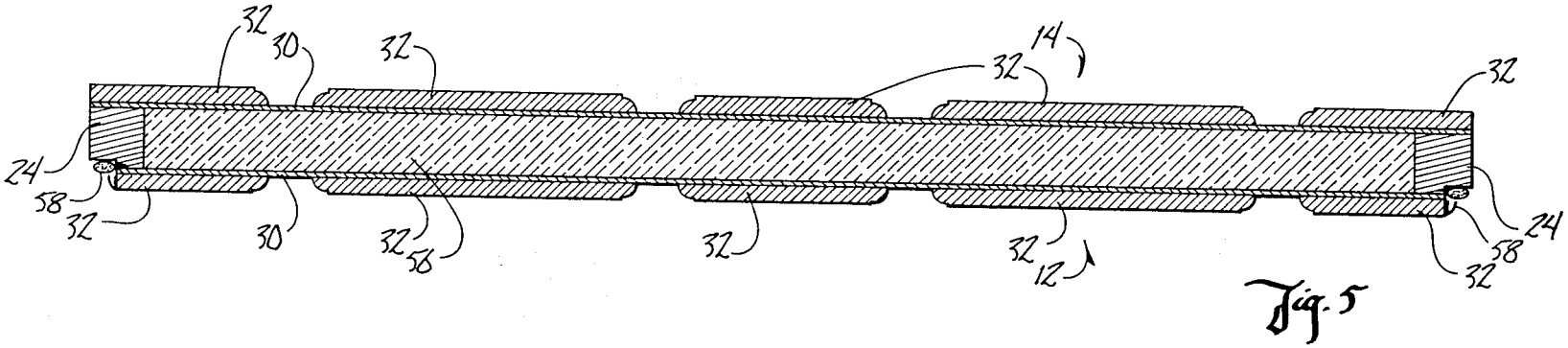
FIG. 5 is a sectional view taken along lines 5—5 of FIG. 1.

The construction of skins 30 and panels 32 are best shown in FIG. 3. Both skin 30 and panels 32 are of laminated construction with a layer of glue (not shown) securing each skin or panel layer to the adjacent layer. An example of a satisfactory glue is TEGO-FILM GP-179/181, manufactured by Goldschmidt, Hopewell, Va., which is applied with heat and pressure.

More particularly, each skin 30 includes an inner backer layer 34, a first cross-banding layer 36, a vapor-barrier layer 38, a second cross-banding layer 40, and an outer veneer layer 42. Preferably, backer layer 34 and cross-banding layers 36 and 40 are constructed of straight grained wood, such as poplar, while outer veneer layer 42 is a hard wood, such as oak. Vapor barrier 38 is preferably aluminum or another similar moisture impervious material. As seen in FIG. 3, the grain direction of backer layer 34 and outer veneer layer 42 runs the length of the door, while the grain direction of cross-banding layers 36 and 40 runs the width of the door so as to provide strength to the door.

The thickness of each layer of skin 30 varies. However, backer layer is preferably 0.036 inch, with a range of 0.015–0.060 inch; cross-banding layers 36 and 40 are preferably 0.062 inch, with a range of 0.015–0.060 inch; vapor barrier layer 38 is preferably 0.010 inch, with a range of 0.002–0.020 inch; and outer veneer layer 42 is preferably 0.033 inch, with a range of 0.015–0.060 inch.

Add-on panel 32 includes a first cross-banding layer 44, an intermediate wood layer 46, a second cross-banding layer 48, a vapor-barrier layer 50, a third cross-banding layer 52, and an outer veneer layer 54. As in skin 30, the cross-banding layers 44, 48 and 52 of panel 32 are preferably constructed of straight grained wood, such as poplar, with the grain direction running across the width of door 10 while outer veneer layer 54 is of a hard wood, such as oak, with the grain direction running along the length of door 10. Preferably, veneer layers 42 and 54 are made of the same wood. Also, vapor barrier layer 50 is constructed of aluminum or another moisture impervious material. Intermediate wood layer 46 is preferably Meranti, but may be the same or similar type wood as outer veneer layer 54. Also, wood layer 46 is stained to match veneer layers 42 and 54.

It is understood that the thicknesses of the layers of panel 32 may vary. However, cross-banding layers 44, 48 and 52 are preferably 0.036 inch, with a range of 0.015–0.060 inch; intermediate wood layer 44 is preferably 0.261 inch, with a range of 0.125–0.475 inch; vapor barrier layer 50 is preferably 0.002, with a range of 0.002–0.020 inch; and outer veneer layer 54 is preferably 0.033 inch, with a range of 0.015–0.060 inch.

Figure 4:
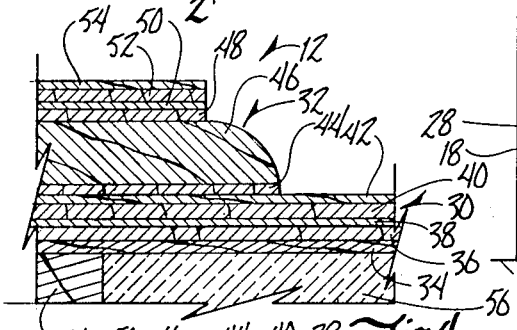
FIG. 4 is a partial sectional view taken along lines 4—4 of FIG. 1.

As best seen in FIG. 4, panel 32 may be routed or molded such that a portion of intermediate wood layer 46 is substantially visible. Thus, to a person viewing door 10 head on, only outer veneer layer 42 of skin 30, intermediate wood layer 46 of panel 32, and outer veneer layer 54 of panel 32 are visible. The cross-banding layers 44, 48 and 52 and the vapor-barrier layer 50 of panel 32 are not generally visible, except upon close inspection of the panel. The various layers of skins 30 beneath outer veneer layer 42 are also not subject to view. Thus, door 10 appears to be of solid wood construction and the aesthetic qualities of the door are maintained.

The interior of door 10 is filled with an insulative material 56, such as foam. Material 56 fills the space between the interior and exterior skins and within the framework of the door.

Figure 2:
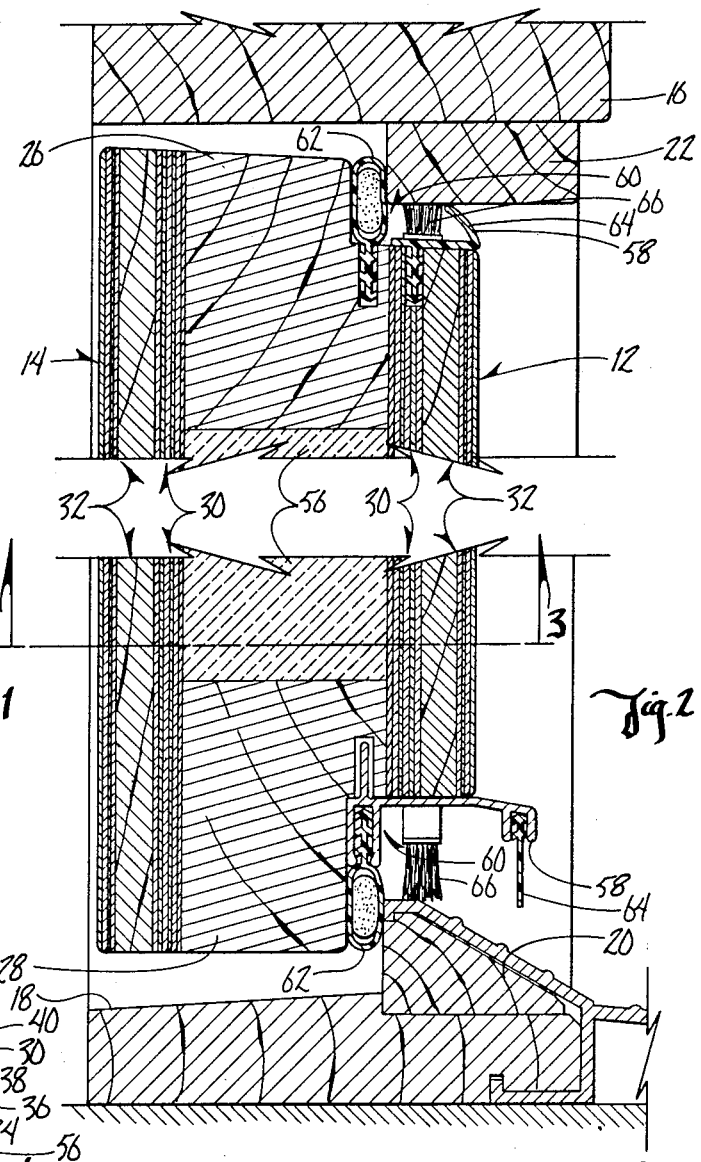
FIG. 2 is a sectional view taken along lines 2—2 of FIG. 1.

Door 10 may be further provided with weatherstripping means 58, as seen in FIG. 2. For example, door 10 may include a notch 60 around the forward peripheral edge, such that a first compressible weatherstripping member 62 can be mounted on notch 60 for compressive sealing engagement with threshhold 20 and door stop member 22, as seen in FIG. 2. An elongated flexible leaf 64 can be mounted along each edge of door 10 forwardly of first weatherstripping member 62 to function as a rain screen to prevent moisture from reaching first weatherstripping member 62. A bristled element 66 is mounted on the corners of door 10 between first weatherstripping member 62 and flexible leaf 63 to fill the corner gap between the ends of adjacent flexible leafs.

Also a layer of aluminized steel or the like may be provided within door 10 for fireproofing.

The laminated construction of skins 30 and panels 32 provide strength to door 10. This strength, along with the insulative quality of material 56, prevents door 10 from warping due to temperature differentials across the door. Also, vapor barrier layer 38 of skins 30 prevent door 10 from warping due to moisture absorption, while vapor-barrier layer 50 of panels 32 prevent warping of the panels due to moisture absorption. Also, the laminated construction of panels 32 prevents the panels from warping due to intense heating by the sun.

The construction of the door 10, including laminated skins 30, laminated panels 32 and insulative core 56, provides door 10 with an insulative R-value of at least 10, as compared to the typical R-value of 2 or 3 for a conventional stile and rail door.

FIGS. 6 through 9 represent an embodiment of the invention wherein all but one very thin layer of the door and excepting the weatherstripping is made of wood. This particular embodiment is designed to be adapted to the desires of purchasers who prefer to have no synthetic materials in the doors that they purchase, while at the same time providing for an economically priced wood door. The door 10A in FIG. 6 has a perimeter framework including opposite elongated side stile frame members 68 and a top rail frame member 69A extending between side stile frame members 68 at the upper ends thereof, and a bottom rail frame member 70 extending between side stile frame members 68 at the lower ends thereof. The door further consists of intermediate rails 70 which are interconnectingly fitted to panels 74. The rails 70 and panels 74 are secured to stiles 72, making up the framework of the door which includes an exterior side 75A and an interior side 75B. The door also includes door sill 77.

Figures 6, 7, 8:
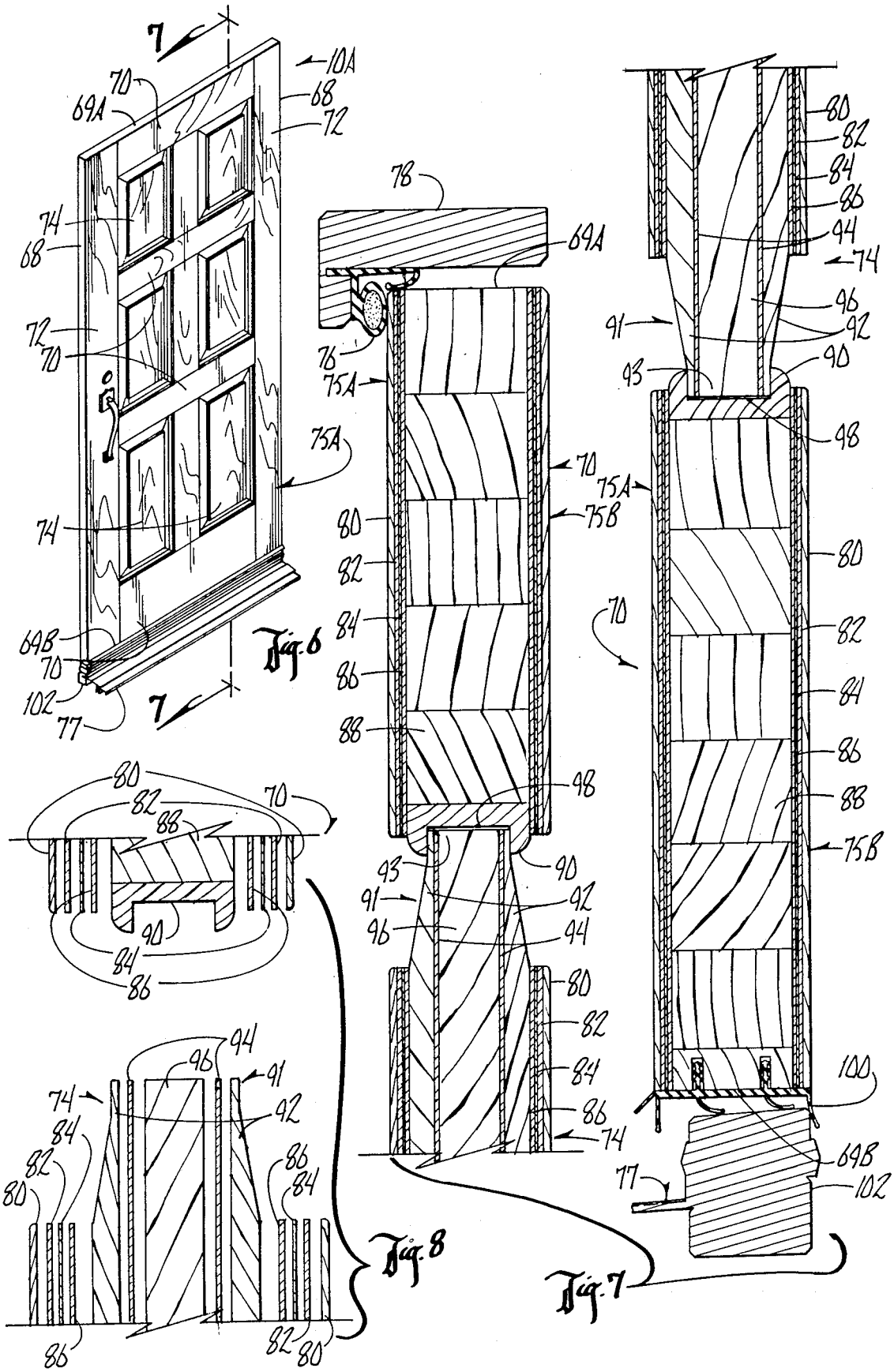
FIG. 6 is a perspective view of an alternate embodiment of the door of the present invention.
FIG. 7 is a sectional view taken along line 7—7 of FIG. 6.
FIG. 8 is an exploded fragmentary sectional view of FIG. 7.
Figure 9:
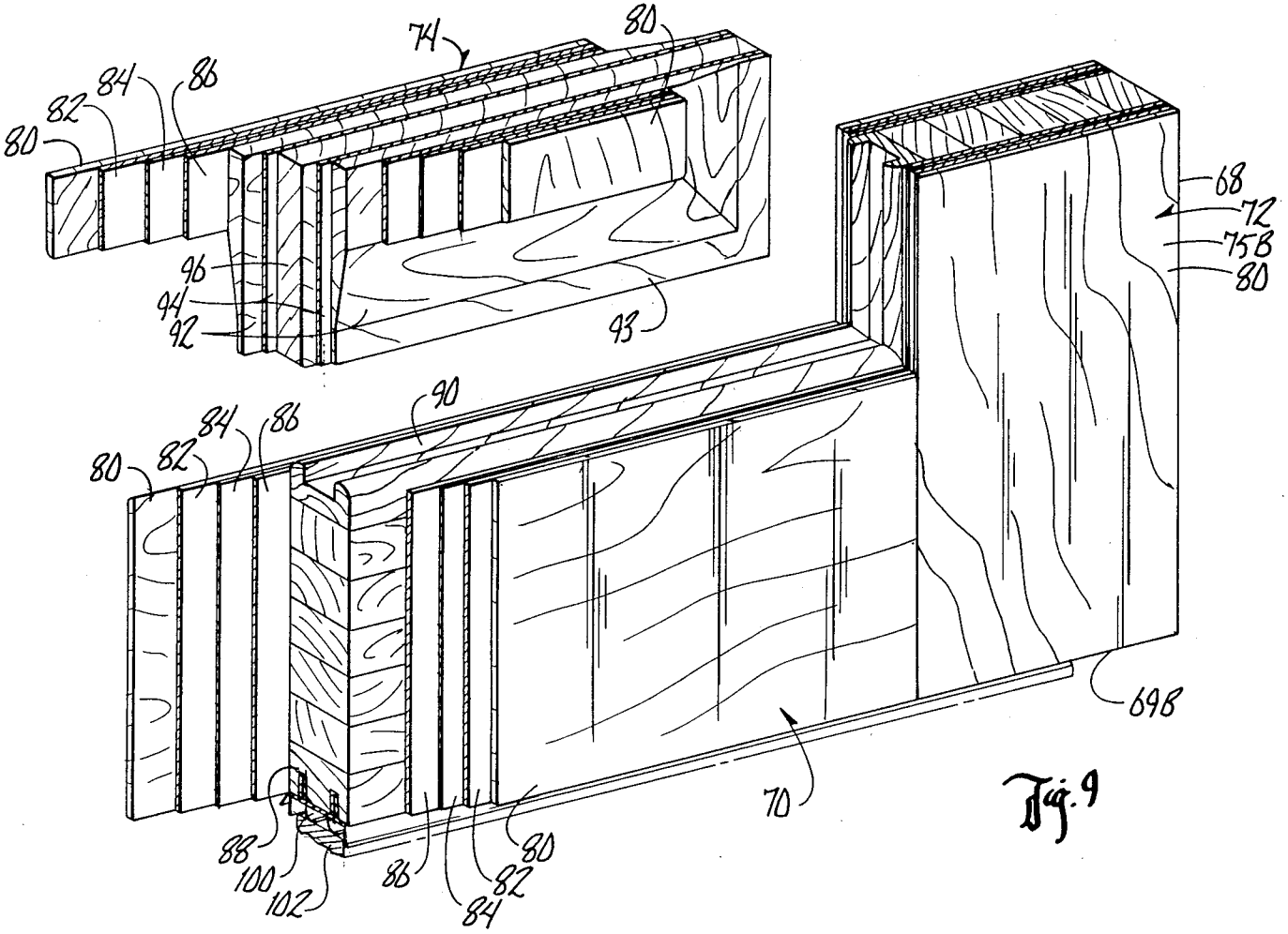
FIG. 9 is an exploded fragmentary perspective view of a cross section of the door of FIG. 6.

FIG. 7 shows a cross section of door 10 as taken through lines 7—7 in FIG. 6. The upper top portion of the cross section is represented on the left side of FIG. 7 and the bottom portion of the cross section is represented on the right-hand side of FIG. 7. This includes weatherstripping 76 attached to header 78 in the top portion, which is not a part of the present invention. The rails 70 consist of an outer oak veneer layer 80, underneath which is a poplar cross-band layer 82, followed underneath by an aluminum vapor-barrier layer 84, which is the only non-wood portion of the door. Underneath aluminum layer 84 is a second poplar cross-band layer 86. The inner core 88 consists of a series of pine sections which run parallel to the grain of the outer oak veneer layer 80. The layers forming the interior side 75B consist of an inner poplar cross-band layer 86, an aluminum vapor-barrier layer 84, another poplar cross-band layer 82 and an outer oak veneer layer 80. The end section consists of a receiving block made of oak 90, which contains a square U-section cut-out at the receiving end of the block designed to adaptingly fit to accept the elongated protruding section 91 of panel 74. Panel 74 consists of an outer oak veneer layer 80, a first poplar cross-band section 82, and an aluminum vapor-barrier layer 84, a second poplar cross-band layer 86, an oak intermediate layer 92 elongated and tapered at one end to form protruding section 91. The preferred embodiment also provides for an inner poplar cross-band layer 94. The inner core 96 consists of a series of horizontal elongated pine blocks. The interior side 75B of the panel section of the door consists of an inner cross-band layer 94, an oak intermediate layer 92 which is elongated and tapered at one end in order to form protruding section 91, a poplar cross-band layer 86, an aluminum vapor-barrier layer 84, a poplar cross-band layer 82 and an outer oak veneer 80. As can be seen in FIG. 7, layers 80 through 86 form the decorative raised layer of the panel, and layers 92 through 96 are elongated and layer 92 elongated and tapered to form an end 93 designed to adaptingly fit into block 90. Between blocks 90 and end 93 a gap exists 98 where sealant is placed in order to improve the bond between the stiles and rails and the panels 74 and to prevent air, water, or other warping or disforming substances from entering into the groove. Preferably, this sealant is urethane caulking. The bottom half of the cross section, as represented in FIG. 9, shows a repetition of this pattern, with elongated portion 91 containing an end 93 designed to adaptingly fit into block 90. The bottom portion of the door also shows weathersealing means 100 and threshold 102. FIG. 8 is an exploded view showing the various layers along with details of the design of receiving oak block 90 and tapering of oak intermediate section 92.

Under the preferable embodiment of the invention, outer oak veneer layer 80 are preferably 0.0625 (1/16) inch with a range of 0.020–0.080 inch; poplar cross-band layers 82, 86, and 94 are preferably 0.0357 (1/28) inch with a range of 0.015–0.062 inch; aluminum vapor-barrier layers 84 are preferably 0.002 inch with a range of 0.001–0.020 inch; and the entire thickness of the door is 1.875 ($1\frac{7}{8}$) inch. The narrowest end of tapered portion 91 is preferably 1.0625 (11/16) inch.

FIG. 9 is a perspective view of FIG. 7 showing the relationship of the various layers.

Thus, the present invention accomplishes at least all of its stated objectives.

What is claimed is:

1. A thermal and moisture resistance door having perimeter edges and interior and exterior sides, comprising: a framework defining the perimeter edges of said door, said framework including parallel opposite elongated stiles extending vertically and horizontally extended rails interconnecting said stiles;

a series of panels secured within said framework to said stiles and rails;

each of said panels comprising a wood core, an intermediate wood layer operatively attached to said core, a wood cross-banding layer attached to said intermediate wood layer, a vapor-barrier layer attached to said cross-banding layer, a second wood cross-banding layer attached to said vapor-barrier layer and an outer wood veneer layer attached to said second cross-banding layer, the wood grain of said intermediate layer and the wood grain of said veneer layer running substantially parallel to one another and the wood grain of at least one of said cross-banding layers running substantially perpendicular to the wood grain of said veneer layer;

said stiles and rails consisting of a wood core, a wood cross-band layer attached to said core; a vapor-barrier layer attached to said cross-band layer, a second wood cross-band layer attached to said vapor-barrier layer and an outer wood veneer layer attached to said second cross-band layer;

said core of each of said panels being elongated and said intermediate wood layer being elongated and tapered to extend beyond the other of said layers of said panel in order to form an end; said stiles and rails including wood receiving blocks to adaptingly receive said end of one of said panels;

wherein the layers of lamination of said panels, stiles and rails provide strength to the said door to prevent warping of the door due to temperature differences across the door and said vapor-barrier layers in said panels, stiles and rails prevent warping of said door due to moisture absorption thereby.

2. The door of claim 1 wherein each of said panels includes an inner cross-band layer secured to said core of said panel and said wood intermediate layer and said inner cross-band layer is elongated to form a portion of the end of said panel.

3. The door of claim 1 wherein said veneer layer is approximately 0.0625 inch.

4. The door of claim 3 wherein said vapor layer is approximately 0.002 inch.

5. The door of claim 4 wherein said cross-banding layer is approximately 0.0357 inch.

6. The door of claim 1 wherein a gap exists between said receiving block and said end of said panel and a sealant is placed therein.

7. The door of claim 6 wherein the sealant is urethane caulk.

8. The door of claim 2 wherein said veneer layers and said intermediate wood layers are of oak material.

* * * * *